United States Patent [19]

Pechner

[11] 4,094,175

[45] June 13, 1978

[54] INTERNAL TUMBLER LOCK KEY CHANGE SYSTEM

[76] Inventor: Julius Pechner, 16010 Blackhawk St., Granada Hills, Calif. 91344

[21] Appl. No.: 752,084

[22] Filed: Dec. 20, 1976

[51] Int. Cl.[2] ..... E05B 25/00

[52] U.S. Cl. ..... 70/364 A; 70/383

[58] Field of Search ..... 70/358, 364 A, 382, 70/383, 384

[56] References Cited

U.S. PATENT DOCUMENTS

| | | | |
|---|---|---|---|
| 2,113,007 | 4/1938 | Swanson | 70/340 |
| 3,210,973 | 10/1965 | Basseches | 70/383 |
| 3,599,456 | 8/1971 | Bessim | 70/383 |

*Primary Examiner*—Robert L. Wolfe
*Attorney, Agent, or Firm*—Lewis B. Sternfels

[57] ABSTRACT

A pin tumbler cylinder lock having a plug rotatable within an external housing, the housing and plug having a row of axially aligned locking bores, a key slot in said plug in alignment with the bores, the lock bores having space for springs, wafers and locking tumbler pins positioned and sized to permit the plug to be operated with a predetermined operating key to lock and unlock the lock when the operating key is inserted into the slot; the housing having a row of auxiliary aligned bores angularly offset from the locking bores, the auxiliary bores having springs and master wafers, the springs biasing the master wafers inwardly toward the plug; and the improvement comprising a relatively thin-walled shutter sleeve fitted for rotation around the plug, the plug being adapted to rotate within the shutter and/or therewith, a row of axially aligned locking bores in said shutter in respective radial and axial alignment with the locking bores in the housing and the plug; first means within the housing and the shutter to prevent rotation of the shutter when the operating key rotates the plug and locks and unlocks the lock; second means within the housing, the shutter, and the plug to permit a lock-changing predetermined key to rotate the plug and the shutter in the housing to respectively align said locking bores in the plug and shutter with the auxiliary bores in the housing; and third means within the housing and the shutter to hold the locking bores in the shutter in alignment with the auxiliary bores when a changing predetermined key is removed from the slot. The wafers in the auxiliary bores may be added to or removed from the locking bores in the plug when the plug bores are in alignment with the auxiliary bores, the wafer changes being in accordance with the shape of a predetermined changing key; and the wafers and/or tumbler pins in each case being adapted to form a break line adjacent the cylinder wall of the shutter to permit its rotation by rotation of the changing key.

23 Claims, 6 Drawing Figures

INTERNAL TUMBLER LOCK KEY CHANGE SYSTEM

BACKGROUND OF THE INVENTION

In the prior art tumbler pin cylinder locks have been adapted to be changed for use with different keys. These kinds of locks have been particularly adaptable for hotels, apartments and office buildings where it is desirable to change the lock for use with a different key.

In these prior locks it was usually necessary to remove the cylinder from the door to make the changes and, in addition, tools were required to be inserted into the cylinders to make the key changes possible.

There have been other changeable locks which could be changed in place, but they also required a tool to be used from externally of the lock.

The present invention has eliminated the requirement for removal of the lock cylinders from the doors and, further, has eliminated the need for the use of an external tool.

SUMMARY OF THE INVENTION

The present invention provides means by which an auxiliary row of reserve master wafers are arranged in alignment with and angularly offset from a row of axially aligned locking bores.

The invention functions with the use of a six-pin changing key in a lock which is normally operated with a five-pin key, for example. It is only with the employment of a predetermined changing key that the changes can be made.

In accordance with the invention, more than a million key variations are possible in five-pin tumbler locks, utilizing five bores containing master wafers of various thicknesses.

Accordingly, it is an object of the invention to provide an improved tumbler lock key change system with substantially unlimited variations.

It is another object of the invention to provide a tumbler lock having a key change system in which predetermined keys make the combination changes.

It is still another object of the invention to provide a tumbler lock, as described in the previous paragraphs, in which the key changes are made entirely internally within the lock and no tools are required.

It is a further object of the invention to provide a tumbler lock in which operating keys can be changed without removing the cylinder from the door.

It is a still further object of the invention to provide a tumbler lock, as described in the previous paragraphs, in which an operating key cannot make the key changes.

It is another object of the invention to provide a tumbler lock having auxiliary bores containing master wafers, which when the plug has been rotated to be aligned with the auxiliary bores, only a proper predetermined changing key is operable to return the plug to be in alignment with the locking bores to effect an operating key change.

It is still another object of the invention to provide a tumbler lock, as described in the preceding paragraphs, in which the rotation of the plug between alignment with the locking bores and the auxiliary bores is precisely limited.

It is a further object of the invention to provide a tumbler lock, as described in the preceding paragraphs, in which the bore in a shutter operated by the changing key is smaller than the locking bores.

It is a still further object of the invention to provide a tumbler lock, as described in the previous paragraphs, in which clearance in the housing cylinder is provided for rotation of the shutter during the rekeying operation and which permits the smaller bore in the shutter to be used by holding means to retain the tumblers in the respective bores when the changing key is removed during the key changing operation.

Further objects and advantages of the invention may be brought out in the following part of the specification wherein small details have been described for the competence of disclosure, without intending to limit the scope of the invention which is set forth in the appended claims.

BRIEF DESCRIPTION OF THE DRAWINGS

Referring to the accompanying drawings, which are for illustrative purposes.

DESCRIPTION OF THE PREFERRED EMBODIMENT

Figure 1:
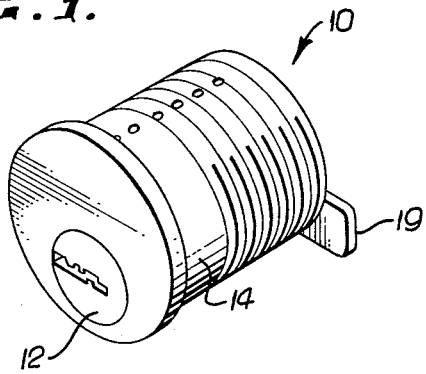
FIG. 1 is a perspective view of a pin tumbler lock.
Figure 2:
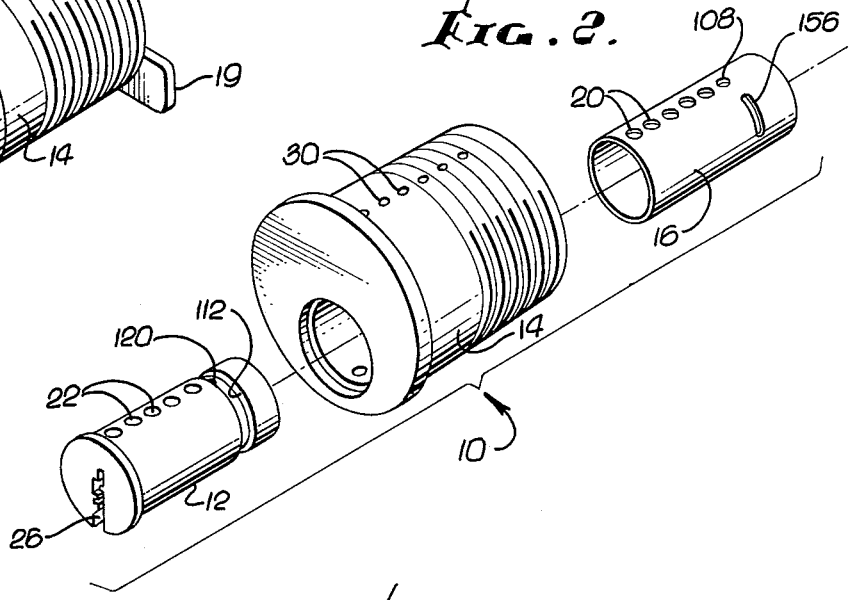
FIG. 2 is an exploded view illustrating a plug, cylinder and shutter in a pin tumbler lock, according to the invention.
Figure 3:
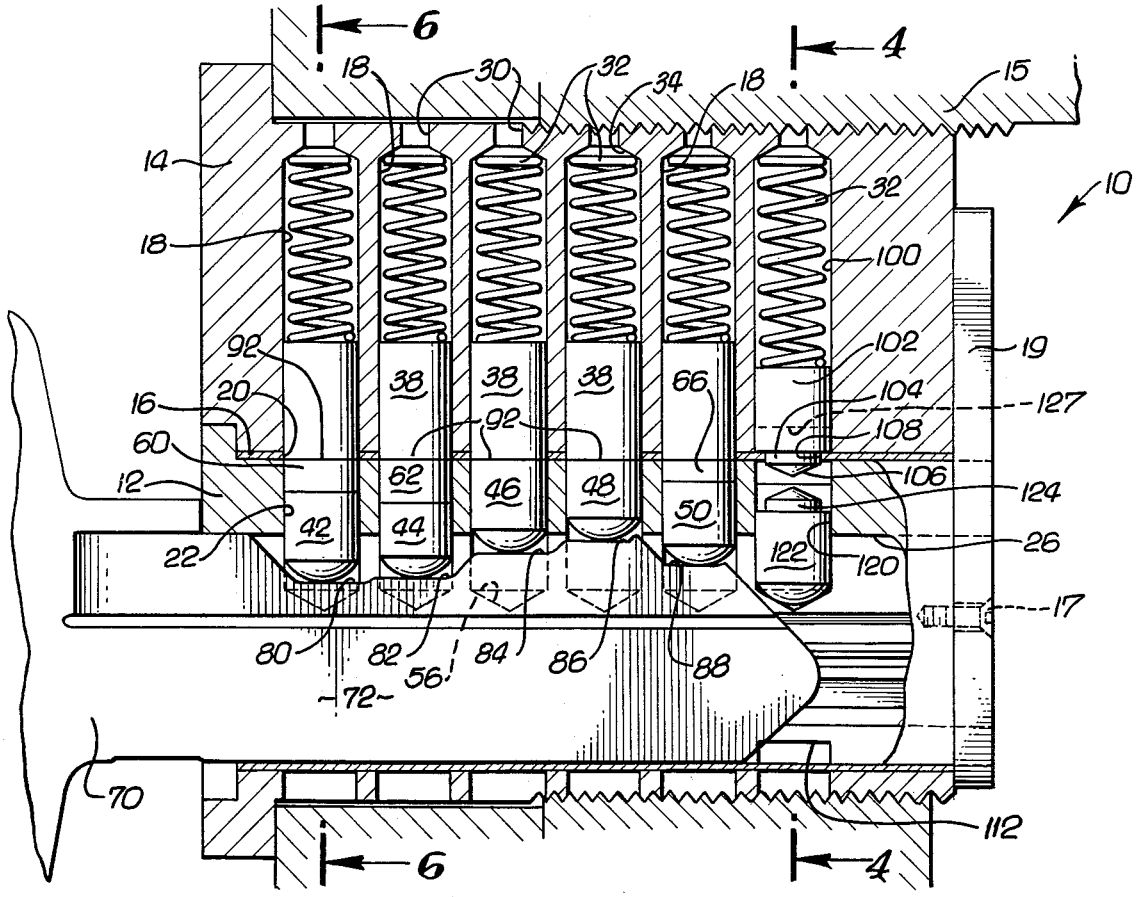
FIG. 3 is a side elevational, partially cross-sectional view of the lock in FIG. 2, operable by a five-pin key and adapted to employ a six-pin key as a changing key.

Referring again to the drawings, there is shown in FIGS. 1–3 a pin tumbler cylinder lock, generally designated as 10, having a generally cylindrical locking and unlocking plug 12, a cylinder or housing 14, and a cylindrical shutter sleeve 16, the plug being adapted to rotate within the shutter during normal locking operations and being adapted to rotate with the shutter within the cylinder during key changing operations.

As shown in FIG. 3, the cylinder 14 is threadedly engaged within a lock frame 15, for example, adapted to be secured within a lock body within a door, and secured to the inner end of the plug by screws 17 is a bolt throwing or latch releasing cam 19 which projects from and turns with the plug to lock or unlock the latch or bolt.

As shown in FIGS. 2–6, the cylinder, the shutter, and the plug have a row of five axially aligned cylindrical locking bores 18, 20 and 22, respectively. Within the plug, radially and axially aligned with the five locking bores, is a key slot 26. The locking bores in the cylinder extend from the lower end thereof, as shown in FIG. 3, and terminate at their upper ends in small diameter portions 30 so that the bores may be loaded from their lower ends. The shutter normally closes the lower ends of the housing bores.

Within each locking bore is a spring 32 in abutment with a conical surface 34 in the upper end of the bore. At the lower end of the springs are cylindrical top tumbler pins 38 slidably fitted within the bores and adapted to be moved upwardly toward the springs by a key, and adapted to be moved downwardly in the cylindrical shutter and plug bores 20 and 22, respectively, when a key is not in the slot. Each top tumbler pin 38 is generally made to be of the same length.

At the lower ends of the locking bores are five bottom, cylindrical, tumbler pins 42, 44, 46, 48 and 50, having convex ends and when a key is not in the slot their lower ends rest at the bottoms 56 of the plug bores 22 where they are held by the force of the springs 32, as indicated in FIG. 3. According to the operating key design, the bottom tumbler pins are of various lengths and, further, according to the operating key design, master wafer pins, as 60, 62 and 66, are inserted between the top tumbler pins and the bottom tumbler pins; the top, master and bottom pins being biased together by the springs 32. The master wafers may be of varying thickness or of the same thicknesses and varied in number, as shown at 60, 62 and 66. In the cases of bottom tumbler pins 46 and 48 of different lengths, according to the specific key design no master wafer pins are used in their locking bores.

Figure 6:
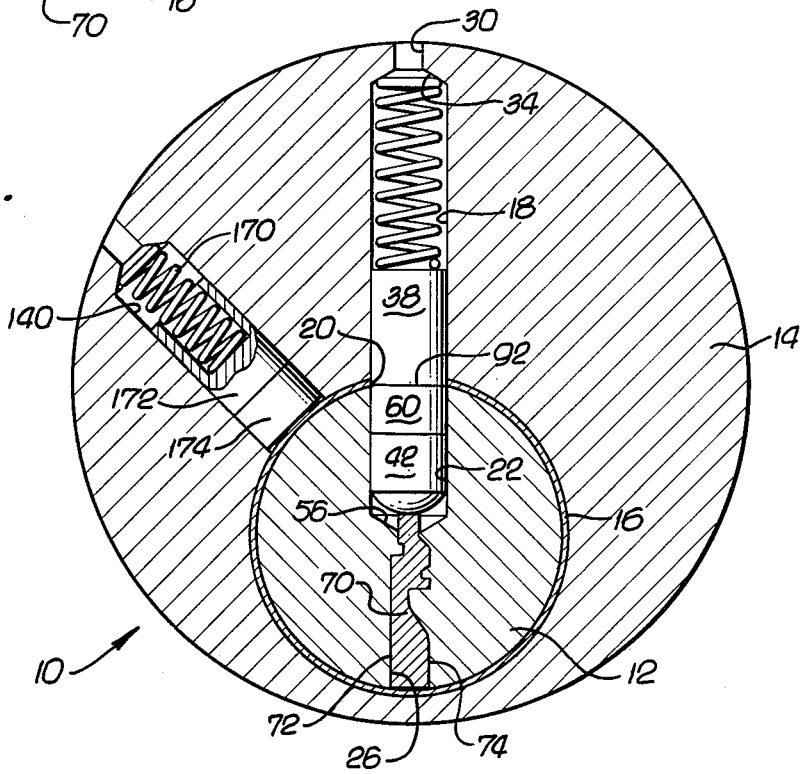
FIG. 6 is a cross-sectional view illustrating a normal locking-unlocking position of the lock, taken along the lines 6—6 of FIG. 3.

As shown in FIGS. 3 and 6, an operating key 70 is in the slot 26 in operating locking and unlocking position. As shown in FIG. 6, the key has a lateral configuration on both sides 72 and 74 adapted to enter the slot 26 axially.

On the upper edge of the five-pin key, for example, are predetermined high and low pin facing contact surfaces 80, 82, 84, 86 and 88. These surfaces engage the lower ends of the bottom tumbler pins 42, 44, 46, 48 and 50, respectively, so as to form a break line 92 between wafers and/or pins just inwardly of the cylindrical wall of the shutter so that rotation of the key will permit rotation of the plug 12 within the shutter 16 to lock or unlock the lock, rotating the cam 19. The ends of any of the cylindrical pins or wafers adapted to form a break line surface are generally flat and fitted for precise operation. If chamfered edges are used, the lock operation is generally not as precise.

Figure 5:
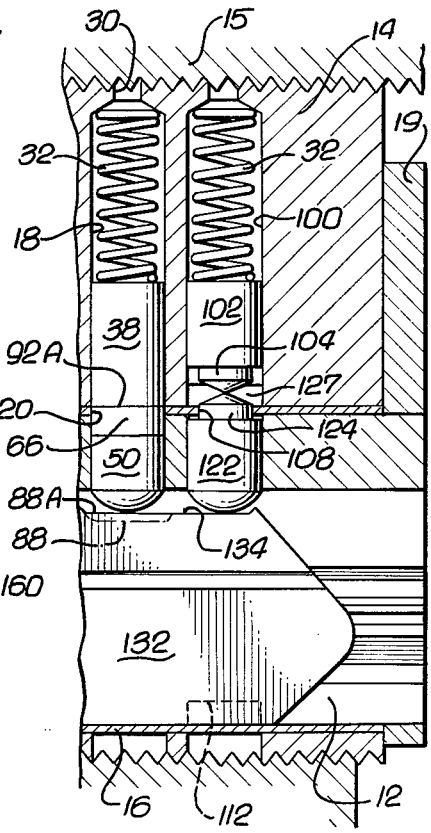
FIG. 5 is a fragmentary cross-sectional view illustrating the use of a changing key.
Figure 4:
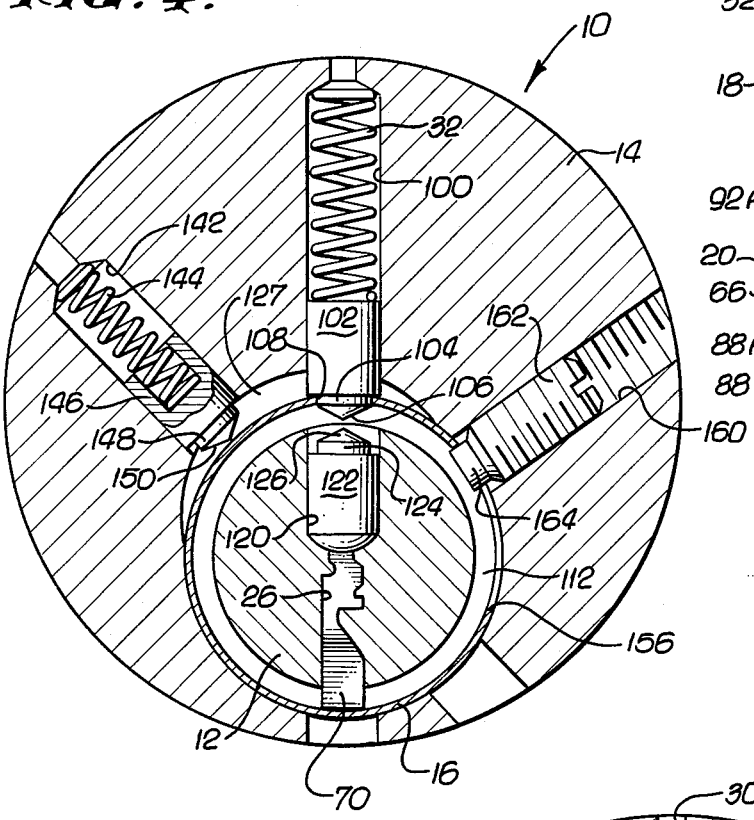
FIG. 4 is a cross-sectional view illustrating structure for use in the key changing operation, taken along the lines 4—4 in FIG. 3.

In axial alignment with the row of five locking bores is a sixth bore 100 within the housing, having therein a spring 32, and in a biasing relationship at the lower end of the spring is a first shutter holding pin 102, as best seen in FIGS. 3–5. The shutter holding pin 102 has a small diameter portion 104 terminating in a conical point 106. In FIGS. 3 and 4 the small diameter portion 104 is biased into a sixth shutter bore 108, smaller in diameter than the five bores 20, and the shoulder on the pin 102 outwardly of the small diameter portion rests on the outer cylindrical surface of the shutter.

In radial or transverse alignment with the shutter holding pin bore 108 is an annular groove 112 in the outer surface of the plug, the conical end 106 extending into the groove. Thus, when the shutter holding pin is extending through the shutter bore 108, the shutter is locked against rotation for operation with a five-pin key, as 70. Extending inwardly from the groove 112 in radial alignment with the bore 100, and in axial row alignment with the locking bores, is a shutter releasing and rotating pin 122. As shown in FIGS. 3 and 4, when a five-pin key is in the plug, the convex bottom of the pin 122 rests on the bottom of the plug bore 120. The pin 122 has an upper reduced diameter portion 124, terminating in a conical end 126, the reduced portion 124 being adapted to fit within the shutter bore 108.

As shown in FIGS. 3 and 4, the pin 102 is extending into a cutaway cavity 127 in the housing, radially outwardly of and in alignment with groove 112. This cavity provides clearance for the rotation of the end 126 of the pin 122 when the end is extending into the shutter bore 108 and the plug and shutter are rotated during the lock-key changing operation, about to be described.

As shown in FIG. 5, there is a six-pin lock changing key 132, corresponding to the operating key 70, having an additional sixth upper edge operating contact or bit surface 134.

The changing key 132 is otherwise identical to the operating key 70 except that its five bit or contacting surfaces, corresponding to surfaces 80, 82, 84, 86 and 88, are regularly higher, as 88A, in FIG. 5, corresponding to 88 in FIG. 3, to raise the break line, as 92A, of all the pins to be just outwardly of the shutter wall.

After the operating key has been removed, the changing key 132 is inserted into the slot for the purpose of changing the lock for operation by a new operating key. The key surface 134 moves the pin 122 in the plug upwardly against the pin 102, moving its small diameter portion out of the shutter bore 108 and moving the small diameter portion 124 therein, FIG. 5. The five contacting surfaces raise wafer pins 60, 62, 66 and the tumbler pins 46 and 48 into the shutter bores to form the new break line 92A, as illustrated for the wafer pin 66 in FIG. 5. In this situation the changing key 132 is adapted to rotate the plug and the shutter within the housing, the conical end 126 being adapted to rotate in the cavity 127. As shown in FIGS. 4 and 6, angularly offset from the locking bores and the shutter holding pin bore 100 in the housing are a row of five axially aligned auxiliary or reserve master pin wafer bores 140 in alignment with a sixth bore 142 which is a second shutter holding pin bore containing a spring 144 and a second shutter holding pin 146, having a small diameter portion 148 and a conical end 150. The bores 140 are in transverse alignment with the respective five locking bores 18 and the bore 142 is in alignment with the bore 100, so that precise rotation of the plug and shutter will radially align their locking bores with respective auxiliary bores. During normal locking operation, the end 150 is in contact with the outer surface of the stationary shutter 16, as shown in FIG. 4.

In order that the rotation of the plug and shutter be precise with respect to the locking and auxiliary bores, as shown in FIGS. 2 and 4, a slot 156 extends through the surface of the shutter in alignment with the groove 112. The slot has about the same width as the diameter of the shutter bore 108. Threadedly engaged within a housing bore 160, FIG. 4, is a set screw 162 having a cylindrical end 164 engaged within the slot 156 and extending into the groove 112. The upper end of the pin 164 is in abutment with the upper end of the slot in which position the pin 102 is in locking position to hold the shutter against rotation.

When the six-pin key 132 is turned to rotate the plug and shutter counterclockwise, having moved the small diameter portion 124 of the pin 122 into the shutter bore 108, the end 126 of the pin 122 rotates in the cavity 127 to engage the conical end 150 of the second shutter holding pin, moving it outwardly against the force of the spring 144. The limit of this rotation is determined by the lower end of the slot 156 which is then in contact with the lower end of the pin 164. At this point the shutter and plug bores are respectively radially aligned with auxiliary bores. When the changing key is then removed, the end 150 of the pin 146 moves into the shutter bore 108 to engage the small diameter portion 148 therewith and to lock the pin 146 in the key changing position.

During the rotation of the shutter 16 and plug 12 by the changing key, as shown in FIG. 5, the raised bottom tumbler pin 50 and the master wafer pin 66 remain radially in place with respect to the shutter and the changing key. The same is true of the other raised bottom tumbler pins 42, 44, 46 and 48 and their master wafer pins 60 and 62 within the shutter and plug.

In each of the five reserve master wafer bores 140, illustrated in FIG. 6, there is a spring 170 extending within a top reserve pin 172 and having at its lower end one or more master wafer reserve pins 174. Thus, when the first changing key 132 is removed from the slot, a second six-pin changing key is inserted into the slot and the wafers 174 in the various five reserve bores will be moved upwardly or downwardly in the bores 140 and the respective shutter and plug bores in accordance with the shape of the key, so that a break line 92A outwardly of the shutter bores 20 is formed to permit rotation by a new operating key. The master reserve wafer pins 174 are of the proper size so that any predetermined new key will position the wafers 174 to form a break line among them for each auxiliary bore just outwardly of the cylindrical walls of the bores 20 of the shutter.

Thus, the new six-pin changing key is adapted to rotate the plug and shutter clockwise back to the position shown in FIG. 4, the pin 122 remaining within the shutter bore 108. When the six-pin changing key is removed, the spring in the housing holding pin bore 100 moves the pin 102 back into the oerating locking position, and the pin 122 drops down into the position as shown in FIGS. 3 and 4. At this point a new operating key, corresponding to the structure of changing key but having lower contacting or bit surfaces, can then be inserted into the slot to operate the lock.

As may be seen, a multiplicity of key changes can be made depending upon the thickness and numbers of the wafers 174 in the auxiliary bores 140. In each case the key must be adapted to position and number the wafers to form a break line so as to permit the rotation of the plug and shutter back to the operating position and to permit rotation of the plug by the operating key while the shutter remains stationary.

The invention and its attendant advantages will be understood from the foregoing description and it will be apparent that various changes may be made in the form, construction and arrangement of the parts of the invention without departing from the spirit and scope thereof or sacrificing its material advantages, the arrangements hereinbefore described being merely by way of example. I do not wish to be restricted to the specific forms shown or uses mentioned except as defined in the accompanying claims, wherein various portions have been separated for clarity of reading and not for emphasis.

I claim:

1. A pin tumbler cylinder lock comprising:
an external housing,
a cylindrical opening therein,
a plug rotatable within said cylindrical opening,
said housing and plug having a row of axially aligned locking bores therein,
a key slot in said plug in alignment with said bores,
each of said locking bores having space for springs, wafers, and locking tumbler pins adapted to be positioned and sized to permit the plug to be operated with an operating predetermined key to lock and unlock the lock when the operating key is inserted into the slot, said springs being adapted to bias said pins toward the key slot,
said housing having a row of axially aligned auxiliary bores angularly offset from and transversely aligned with respective locking bores,
each of said auxiliary bores adapted to have springs and master wafers therein, said springs being adapted to bias said master wafers inwardly toward the plug,
a relatively thin-walled shutter sleeve fitted for rotation in said cylindrical opening in said housing,
said plug being fitted within said shutter sleeve for rotation therein and therewith,
a row of axially aligned locking bores in said shutter sleeve in respective radial and axial alignment with the locking bores in said housing and said plug,
first means within the housing and the shutter to prevent rotation of the shutter during operation of the lock when said operating key rotates the plug to lock and unlock the lock, and
second means within the housing, the shutter, and the plug actuated by a lock-combination-changing predetermined key to permit said lock-combination-changing predetermined key to rotate the plug and the shutter in the housing from the operating position of the lock to a combination-changing position of the lock by respectively aligning said locking bores in the plug and shutter with said auxiliary bores in the housing.

2. The invention according to claim 1, including:
third means within said housing and said shutter to hold the locking bores in the shutter in alignment with said auxiliary bores in the housing when said changing predetermined key is removed from the slot.

3. The invention according to claim 2, including:
means within said housing and said shutter to precisely align the locking bores in the shutter and plug with respective one of said auxiliary bores when a changing predetermined key is used to rotate for such alignment.

4. The invention according to claim 2, including:
means within said housing and said shutter to precisely align the locking bores in the shutter and plug with the locking bores in the housing when a changing predetermined key is used to rotate the shutter and plug locking bores into respective alignment with the housing locking bores.

5. A pin tumbler cylinder lock comprising:
an external housing,
a cylindrical opening therein,
a plug rotatable within said cylindrical opening,
said housing and plug having a row of axially aligned locking bores therein,
a key slot in said plug in alignment with said bores,
each of said locking bores having space for springs, wafers, and locking tumbler pins adapted to be positioned to and sized to permit the plug to be operated with an operating predetermined key to lock and unlock the lock when the operating key is inserted into the slot, said springs being adapted to bias said pins toward the key slot,
said housing having a row of axially aligned auxiliary bores angularly offset from and transversely aligned with respective locking bores, each of said auxiliary bores adapted to have springs and master wafers therein, said springs being adapted to bias said master wafers inwardly toward the plug, a relatively thin-walled shutter sleeve fitted for rotation in said cylindrical opening in said housing, said plug being fitted within said shutter sleeve for rotation therein and therewith, a row of axially aligned locking bores in said shutter sleeve in respective radial and axial alignment with the locking bores in said housing and said plug, first means within the housing and the shutter to prevent rotation of the shutter when said operating key rotates the plug to lock and unlock the lock, second means within the housing, the shutter, and the plug to permit a lock-changing predetermined key to rotate the plug and the shutter in the housing to respectively align said locking bores in the plug and shutter with said auxiliary bores in the housing, said wafers from said auxiliary bores capable of being added to the locking bores, or said wafers from said locking bores capable of being removed from the locking bores in the plug in accordance with the shape of a predetermined changing key inserted into the key slot when the plug bores are in respective alignment with the auxiliary bores, and the wafers and/or tumbler pins as positioned by the changing key being adapted to form a break line at the outer cylindrical wall of the shutter to permit its rotation by rotation of the changing key.

6. The invention according to claim 5, in which:

after said last predetermined changing key has rotated the plug and shutter locking bores into alignment with said housing locking bores, and the changing key has been removed, a predetermined operating key corresponding to the changing key will operate the lock.

7. A pin tumbler cylinder lock comprising:

an external housing, a cylindrical opening therein, a plug rotatable within said cylindrical opening, said housing and plug having a row of axially aligned locking bores therein, a key slot in said plug in alignment with said bores, each of said locking bores having space for springs, wafers, and locking tumbler pins adapted to be positioned to and sized to permit the plug to be operated with an operating predetermined key to lock and unlock the lock when the operating key is inserted into the slot, said springs being adapted to bias said pins toward the key slot, said housing having a row of axially aligned auxiliary bores angularly offset from and transversely aligned with respective locking bores, each of said auxiliary bores adapted to have springs and master wafers therein, said springs being adapted to bias said master wafers inwardly toward the plug, a relatively thin-walled shutter sleeve fitted for rotation in said cylindrical opening in said housing, said plug being fitted within said shutter sleeve for rotation therein and therewith, a row of axially aligned locking bores in said shutter sleeve in respective radial and axial alignment with the locking bores in said housing and said plug, first means within the housing and the shutter to prevent rotation of the shutter when said operating key rotates the plug to lock and unlock the lock, comprising a first shutter holding pin within a housing shutter pin bore, said first shutter holding pin being not adapted to be operated by an operating key and being spring biased into a shutter holding bore, and second means within the housing, the shutter, and the plug to permit a lock-changing predetermined key to rotate the plug and the shutter in the housing to respectively align said locking bores in the plug and shutter with said auxiliary bores in the housing, said first means being operable by said predetermined changing key within and associated with said second means.

8. The invention according to claim 7, in which:

said first shutter holding pin and said housing shutter pin bore are axially aligned with said rows of locking bores in said housing, said shutter, and said plug, said second means including a shutter releasing and rotating pin within the plug in axial alignment with the locking bore rows and in radial alignment with the shutter holding bore.

9. The invention according to claim 8, in which:

said second means further includes an annular groove in said plug in substantial radial and axial alignment with said first shutter holding pin, said housing shutter pin bore, said shutter holding bore, and said shutter releasing and rotating pin when said second means is in the normal lock operating position, and a cutaway cavity portion enlarging said cylindrical opening in said housing being radially outwardly of said groove, a portion of said shutter, and said shutter releasing and rotating pin, said cutaway portion being effectively axially alignable with said first shutter holding pin, said housing shutter pin bore, said shutter holding bore, said shutter releasing and rotating pin, and said third means, said cutaway portion being adapted to permit the rotation of the plug and shutter so that locking bores in the shutter and plug are rotated into alignment with the auxiliary bores when the shutter releasing and rotating pin is in the shutter holding bore and the plug, and the shutter is rotated by a predetermined changing key acting on the shutter releasing and rotating pin.

10. The invention according to claim 9, including:

third means in axial row alignment with said auxiliary bores in said housing and in radial alignment with said cutaway portion, said third means including a bore in said housing and having a second shutter holding pin therein spring biased to force said second holding pin into said shutter holding bore when said shutter and plug have been rotated by a predetermined changing key to align said shutter releasing and rotating pin and said shutter holding bore into alignment with said second holding pin and said predetermined changing key has been removed.

11. The invention according to claim 10, in which:

said first and second shutter holding pins and said shutter releasing and rotating pin have reduced diameter end portions adapted to fit into said shutter holding bore, said pins having enlarged diameters inwardly of the reduced diameters to limit penetration of the enlarged diameters into the shutter holding bore.

12. The invention according to claim 11, including:

a fixed limiting pin in said housing being adapted to limit the rotation of said shutter, said shutter having an annular slot of predetermined length through its cylindrical surface, said limiting pin extending into said slot, said slot and limiting pin being adapted to precisely align the locking bores in the shutter and plug with said auxiliary bores when a changing predetermined key is used to rotate said shutter and plug for such alignment, said slot and limiting pin being adapted to precisely align the locking bores in the shutter and plug with the locking bores in the housing when a changing predetermined key is used to rotate the shutter and plug locking bores into alignment with the housing locking bores.

13. The invention according to claim 1, in which:

said each lock operating key corresponds to a changing key for lock operation, and each new changing key corresponds to a new operating key.

14. The invention according to claim 2 in which:

each predetermined lock operating key is incapable of operating said second means, each lock operating key corresponds to a predetermined lock changing key adapted to operate said second means.

15. The invention according to claim 2, in which:

a new predetermined lock operating key is determined by the insertion of a new predetermined changing key into the slot when the third means is holding the shutter in alignment with the auxiliary bores after a prior changing key has been removed from the slot.

16. The invention according to claim 1, in which:

the wafers and/or tumbler pins in each bore being adapted to form a break line inside the shutter for rotation of the plug within the shutter by rotation of an operating key.

17. The invention according to claim 1, in which:

wafers may be added to or removed from the locking bores in the plug in accordance with the shape of a predetermined changing key inserted into the key slot when the plug bores are in respective alignment with the auxiliary bores.

18. The invention according to claim 1, in which:

the wafers and/or tumbler pins in each locking bore being adapted to form a break line outside the shutter when a changing key is in the key slot.

19. A key-operated pin tumbler lock with integral combination changing means not requiring removal of the lock from its emplacement of use comprising in combination:

a plurality of pairs of uniquely configured lock operating keys and lock combination changing keys;

a housing;

a plug rotatable in said housing and having a key-receiving slot for receiving any of said keys;

first means including elements in and extending between said plug and said housing and cooperable with a selected pair of said keys for establishing a unique locking and unlocking rotational engagement between said plug and said housing;

second means including reserve elements in said housing cooperable with said lock combination changing keys for adding said reserve elements to and for subtracting said first means elements from said first means, for changing the unique locking and unlocking rotational engagement to other different but unique engagements;

a shutter positioned between said housing and said plug; and third means normally securing said shutter and said housing together and capable of engagement only by said lock combination changing keys, wherein said lock combination changing keys of said selected pair of said keys, said third means and said first means elements cooperate to release said shutter for rotation with said plug, thereby for enabling the adding of said reserve elements to and the subtracting of said first means elements from said first means upon replacement of said lock combination changing key of said selected pair of said keys with another of said combination changing keys.

20. The key-operated lock of claim 19 wherein said third means is axially displaced from said first means along said plug, said shutter and said housing, said lock combination changing keys and said lock operating keys both have contact surfaces for contact with said first means elements, and said lock combination changing keys each have an additional contact surface for contact with said third means.

21. The key-operated lock of claim 20 wherein said shutter has a discrete thickness and said contact surfaces of said lock combination changing keys are higher than said contact surfaces of said lock operating keys to an extent equalling the sleeve discrete thickness.

22. A key-operated pin tumbler lock with integral combination changing means not requiring removal of the lock from its emplacement of use comprising in combination:

at least two pairs of keys, each pair including a uniquely configured lock operating key and a lock combination changing key;

a housing;

a plug rotatable in said housing and having a key-receiving slot for individually receiving said keys;

first means cooperable with said plug and said housing and engageable by said lock operating key for establishing a unique locking and unlocking rotational engagement between said plug and said housing;

second means cooperable only with said lock combination changing key for enabling the unique locking and unlocking rotational engagement to be changed to another different but unique engagement;

a shutter positioned between said housing and said plug; and third means normally securing said shutter and said housing together and adapted to be engaged only by said lock combination changing key, said third means being cooperable with said lock combination changing key and said first means to release said shutter for rotation with said plug, thereby changing the unique locking and unlocking rotational engagement to the other different but unique engagement upon replacement of said lock combination changing key with another lock combination changing key.

23. A pin tumbler cylinder lock comprising:

a housing, a plug coupleable to and moveable in said housing by an operating key to lock and unlock the lock in a unique combination, a shutter between said housing and said plug and relatively moveable therewith between at least two positions, means normally coupling said shutter with said housing to prevent relative movement therebetween and movement of said shutter between its positions, said coupling means being not adapted to be operated by said operating key when said operating key moves said plug to lock and unlock the lock, and second means in said housing, said shutter, and said plug and coupleable with a lock-combination changing key to permit said lock-changing combination key to move said plug and said shutter in said housing and to permit the unique combination to be changed to another unique combination, said first means being operable by said lock-combination changing key.

* * * * *